US010566739B2

(12) United States Patent
Pachón

(10) Patent No.: US 10,566,739 B2
(45) **Date of Patent: *Feb. 18, 2020**

(54) HIGH DENSITY MULTICHANNEL TWISTED PAIR COMMUNICATION SYSTEM

(71) Applicant: CommScope Connectivity Spain, S.L., Alcobendas (Madrid) (ES)

(72) Inventor: Arturo Pachón, Badalona (ES)

(73) Assignee: CommScope Connectivity Spain, S.L. (ES)

( * ) Notice: Subject to any disclaimer, the term of this patent is extended or adjusted under 35 U.S.C. 154(b) by 0 days.

This patent is subject to a terminal disclaimer.

(21) Appl. No.: 15/985,086

(22) Filed: May 21, 2018

(65) Prior Publication Data

US 2019/0140398 A1 May 9, 2019

Related U.S. Application Data

(63) Continuation of application No. 15/440,997, filed on Feb. 23, 2017, now abandoned, which is a (Continued)

(51) Int. Cl.
*H01R 13/64* (2006.01)
*H01R 13/6463* (2011.01)
(Continued)

(52) U.S. Cl.
CPC ..... *H01R 13/6463* (2013.01); *H01R 12/00* (2013.01); *H01R 12/75* (2013.01);
(Continued)

(58) Field of Classification Search
CPC .... H01R 13/6463; H01R 12/00; H01R 12/75; H01R 25/006
(Continued)

(56) References Cited

U.S. PATENT DOCUMENTS 5,649,829 A * 7/1997 Miller ..... H01R 9/24 439/49
5,864,089 A * 1/1999 Rainal ..... H01R 13/719 174/376

(Continued)

FOREIGN PATENT DOCUMENTS

EP 2 224 547 A1 9/2010
WO WO 03/043138 A1 5/2003

OTHER PUBLICATIONS

International Search Report and Written Opinion for PCT/IB2012/002991 dated Jun. 28, 2013.

*Primary Examiner* — Alexander Gilman
(74) *Attorney, Agent, or Firm* — Merchant & Gould P.C.

(57) ABSTRACT

A twisted pair communications device and associated twisted pair communications system are disclosed. One twisted pair communications device includes a plurality of twisted pair connectors each associated with a different twisted pair communication channel, and a multi-channel connector communicatively connected to each of the plurality of twisted pair connectors. The multi-channel connector is configured to transmit and receive communication signals associated with each of the twisted pair communication channels on a multi-channel twisted pair cable and includes a plurality of wire pairs disposed in a plurality of rows within the connector. Fewer than all of the plurality of wire pairs are communicatively connected to twisted pair connectors, and wherein unassociated wire pairs in the multi-channel connector separate at least two groups of wire pairs associated with different twisted pair communication channels.

16 Claims, 9 Drawing Sheets

Related U.S. Application Data continuation of application No. 13/722,598, filed on Dec. 20, 2012, now Pat. No. 9,601,847.

(60) Provisional application No. 61/579,578, filed on Dec. 22, 2011.

(51) Int. Cl.

| | |
|---|---|
| ***H01R 12/00*** | (2006.01) |
| ***H01R 12/75*** | (2011.01) |
| ***H01R 13/6466*** | (2011.01) |
| ***H01R 13/6469*** | (2011.01) |
| ***H01R 25/00*** | (2006.01) |
| *H01R 24/64* | (2011.01) |
| *H01R 107/00* | (2006.01) |

(52) U.S. Cl.
CPC ..... *H01R 13/6466* (2013.01); *H01R 13/6469* (2013.01); *H01R 25/006* (2013.01); *H01R 24/64* (2013.01); *H01R 2107/00* (2013.01); *H01R 2201/04* (2013.01)

(58) Field of Classification Search
USPC ..... 439/78
See application file for complete search history.

(56) References Cited

U.S. PATENT DOCUMENTS 5,997,358 A * 12/1999 Adriaenssens ..... H05K 1/0228 439/395
6,565,391 B2 * 5/2003 Bernstein ..... H01R 23/6873 439/676
6,859,045 B2 * 2/2005 Fernandez ..... H04B 3/46 324/539
6,866,548 B2 * 3/2005 Hashim ..... H01R 13/6464 439/676
6,976,867 B2 * 12/2005 Navarro ..... H01R 13/641 439/489
6,988,914 B2 * 1/2006 Pepe ..... H01R 31/02 439/638
7,023,809 B1 * 4/2006 Rubinstein ..... H04L 12/6418 370/241
7,331,816 B2 * 2/2008 Krohn ..... H01R 13/6471 439/502
7,345,890 B2 * 3/2008 DeNies ..... H05K 7/1409 361/679.55
7,530,818 B1 * 5/2009 Wang ..... H01R 31/065 439/638
7,530,854 B2 * 5/2009 Aekins ..... H01R 13/7195 439/676
7,677,931 B2 3/2010 Aekins
7,729,416 B2 * 6/2010 Theodoras, II ..... H04L 5/1423 370/420
7,765,358 B2 * 7/2010 Rutherford, III ... G06F 13/4022 439/166
7,909,619 B2 * 3/2011 Pepe ..... H01R 13/514 439/541.5
7,909,622 B2 3/2011 Pepe et al.
7,909,643 B2 * 3/2011 Pepe ..... H01R 13/6658 439/540.1
8,616,923 B2 * 12/2013 Bopp ..... H01R 13/6658 439/676
8,882,514 B2 * 11/2014 Enge ..... H01R 9/032 439/676
9,601,847 B2 * 3/2017 Pachon ..... H01R 12/00
2001/0008189 A1 * 7/2001 Reede ..... H01R 13/6463 174/116
2004/0057224 A1 * 3/2004 Kiko ..... H05K 1/181 361/828
2005/0196987 A1 * 9/2005 Shuey ..... H01R 13/6471 439/108
2008/0268710 A1 * 10/2008 Hashim ..... H05K 1/0228 439/620.21
2010/0022115 A1 * 1/2010 Thijs ..... H01R 13/443 439/345
2010/0221951 A1 * 9/2010 Pepe ..... H01R 13/516 439/607.25
2010/0279519 A1 * 11/2010 Mei ..... H01R 31/005 439/55
2011/0237116 A1 * 9/2011 Heckmann ..... A61F 2/4081 439/391
2013/0164994 A1 * 6/2013 Pachon ..... H01R 12/00 439/676

* cited by examiner

HIGH DENSITY MULTICHANNEL TWISTED PAIR COMMUNICATION SYSTEM

CROSS-REFERENCE TO RELATED APPLICATIONS

This application is a continuation of application Ser. No. 15/440,997, filed Feb. 23, 2017, which is a continuation of application Ser. No. 13/722,598, filed Dec. 20, 2012, now U.S. Pat. No. 9,601,847, which application claims the benefit of provisional application Ser. No. 61/579,578, filed Dec. 22, 2011, which applications are incorporated herein by reference in their entirety.

TECHNICAL FIELD

The present disclosure relates generally to twisted pair communication systems. In particular, the present application relates to a high density multichannel twisted pair communication system.

BACKGROUND

It is common in building wiring closets where hubs and routers are located for distribution and/or storage of data, to have a plurality of racks and panels with multiple electrical interconnections formed by multiple cables. It is commonplace to have such electrical connections made by connection systems known as modular plugs and jacks, such as an RJ-45 connection system, or other systems such as an RJ-21 connection system. Separate connection systems have traditionally been used, due to the speed of the data, the need to minimize EMI radiation, as well as the need to minimize crosstalk between adjacent lines in the same connector.

Various electrical connection systems have been developed which provide for data interconnections and shielding of wires. Example connection systems are discussed in U.S. Pat. Nos. 5,649,829 and 5,380,223. However, these connector systems are generally constructed for situations where space is not at a premium, and generally these systems are constructed for operation at frequencies today considered to be of a standard to slow frequency range (e.g., at or below about 100 MHz).

To overcome some of the deficiencies of these systems, compact multichannel data interconnections have been developed. One such interconnection is discussed in U.S. Pat. No. 6,582,255, assigned to Tyco Electronics Corporation. This interconnect type, known generally as an "MRJ21" connector, provides a connector within which two sets of twelve terminal pairs are provided. Such a connector has been used in systems for condensed, multichannel communications. For example, as illustrated in FIG. 1, a twisted pair communications system 10 and associated high density device 12 is illustrated. In the example shown, an MRJ21 connector 14 is interconnected to six RJ-45 connectors 16*a-f* at the device, each of which uses four pairs of wires (8 total wires). The twisted pair communications device 12 includes associated RJ-45 jacks configured to receive the RJ-45 connectors 16*a-f*, and an MRJ connector configured to interconnect to the MRJ21 connector 14 and associated cable 18. As seen in this arrangement, the MRJ21 connector 14 allows for higher-density, combined channel communications between two or more devices, thereby increasing the density of wiring connectivity in circumstances where each of a number of channels of data (e.g., each channel being routed to a different RJ-45 connection).

FIG. 2 provides a schematic view of the twisted pair communications device of FIG. 1. As shown, a plurality of RJ-45 jacks 22*a-f*, configured to receive the RJ-45 connectors 16*a-f*, are interconnected to an MRJ21 connector port 20 via a circuit board 24. In this embodiment, since each RJ-45 jack 22 uses eight wires (i.e., four pairs), a maximum of six RJ-45 jacks can be interconnected to the MRJ21 connector port 24, thereby increasing the density of data communication. As shown in FIG. 3, a schematic illustration of the MRJ21 connector pinout capable of interconnection to the MRJ21 connector port 24 of the device of FIGS. 1-2 illustrates the existence of these 24 pairs of wires. Because interconnection to each RJ-45 jack 22*a-f* requires four pairs, each of the 24 pairs in the MRJ21 connector port 24 are occupied or associated with a particular RJ-45 wire from one of the RJ-45 jacks 22*a-f*.

Systems such as those illustrated in FIGS. 1-3, as well as those mentioned in the patent references above, have deficiencies. In particular, the system of FIGS. 1-3 has a high density and therefore includes a number of closely-spaced wires within each connector. These wires can, at high frequency, have detrimental performance effects on each other, in the form of alien crosstalk and other forms of crosstalk interference. This interference causes signal degradation and data failures at higher frequencies. For networks implementing higher throughput data (e.g., 10 GbE communications) at frequencies up to and exceeding 250-500 MHz, existing high density connection schemes such as those discussed above therefore are inadequate.

SUMMARY

In a first aspect, a twisted pair communications device includes a plurality of twisted pair connectors each associated with a different twisted pair communication channel, and a multi-channel connector communicatively connected to each of the plurality of twisted pair connectors. The multi-channel connector is configured to transmit and receive communication signals associated with each of the twisted pair communication channels on a multi-channel twisted pair cable and includes a plurality of wire pairs disposed in a plurality of rows within the connector. Fewer than all of the plurality of wire pairs are communicatively connected to twisted pair connectors, and wherein unassociated wire pairs in the multi-channel connector separate at least two groups of wire pairs associated with different twisted pair communication channels.

In a second aspect, a twisted pair communications system includes a twisted pair communications device and a multi-channel communication cable. The twisted pair communications device includes a plurality of RJ-45 connectors each associated with a different twisted pair communication channel and connected to an RJ-45 plug, and a multi-channel connector communicatively connected to each of the plurality of RJ-45 connectors and configured to transmit and receive communication signals associated with each of the twisted pair communication channels on a multi-channel twisted pair cable. The multi-channel connector includes a plurality of wire pairs disposed in a plurality of rows within the connector. The multi-channel communication cable is communicatively connected to the multi-channel connector, and includes a plurality of twisted pair wires grouped into a plurality of channels, each of the channels connected to corresponding twisted pair communication channels received at the twisted pair communication device on the plurality of RJ-45 connectors. In the system fewer than all of the plurality of wire pairs are communicatively connected to RJ-45 connectors, and unassociated wire pairs in the multi-channel connector separate at least two groups of wire pairs associated with different twisted pair communication channels.

In a third aspect, a twisted pair communications system includes first and second twisted pair communications devices and a multi-channel communication cable. Each of the first and second twisted pair communications devices includes a plurality of RJ-45 connectors each associated with a different communication channel, as well as a multi-channel connector communicatively connected to each of the plurality of RJ-45 connectors and configured to transmit and receive communication signals associated with each of the twisted pair communication channels on a multi-channel twisted pair cable. The multi-channel connector includes a plurality of wire pairs disposed in a plurality of rows within the connector. Each of the first and second twisted pair communications devices also includes a circuit board to which the plurality of RJ-45 connectors and the multi-channel connector are mounted, the circuit board including conductive traces communicatively connecting the multi-channel connector to each of the plurality of RJ-45 connectors. The multi-channel communication cable communicatively is connected between the first and second twisted pair communication devices at the multi-channel connector of the first and second twisted pair communication devices, and includes a plurality of twisted pair wires grouped into a plurality of channels. Each of the channels is connected to corresponding twisted pair communication channels received at the twisted pair communication device on the plurality of RJ-45 connectors. Fewer than all of the plurality of wire pairs of the multi-channel connector of at least one of the first and second twisted pair communication devices are communicatively connected to RJ-45 connectors of that twisted pair communication device, and unassociated wire pairs in the multi-channel connector separate at least two groups of wire pairs associated with different twisted pair communication channels, thereby reducing alien crosstalk between the twisted pair communication channels.

DETAILED DESCRIPTION

Reference will now be made in detail to the exemplary aspects of the present disclosure that are illustrated in the accompanying drawings. Wherever possible, the same reference numbers will be used throughout the drawings to refer to the same or like structure.

In general, the present disclosure relates to a high density multichannel twisted pair communication system including a particular layout of connectors and twisted pair wires to minimize crosstalk among channels at high frequencies. By minimizing crosstalk, increased frequencies can be used, for example to support 1 gigabit or even 10 gigabit Ethernet speeds.

Figure 4:
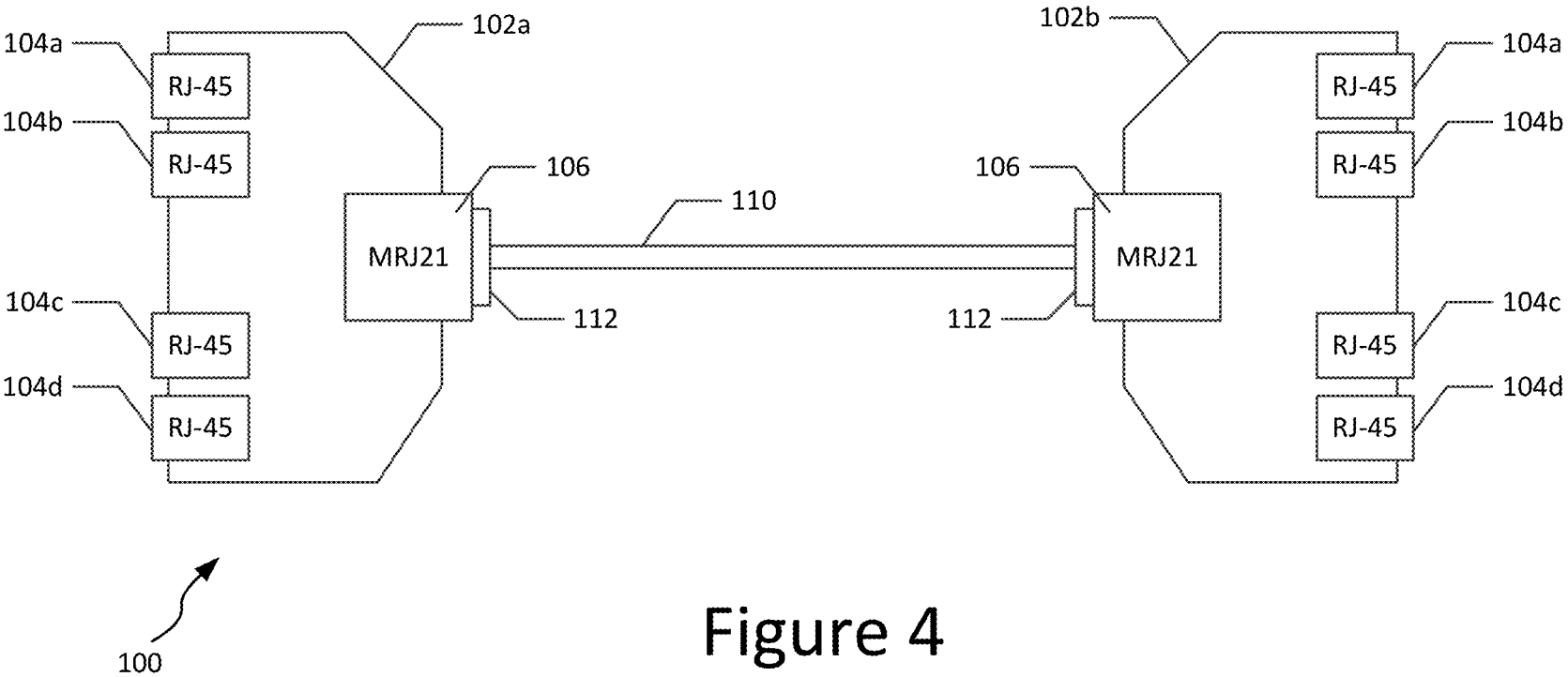
FIG. 4 illustrates a high density multichannel twisted pair communication system according to an example embodiment.

Referring now to FIG. 4, an example high density multichannel twisted pair communication system 100 is illustrated. The system 100 includes one or more twisted pair communication devices 102. In the embodiment shown, the system 100 includes two twisted pair communication device 102*a-b*. Each twisted pair communication device is generally configured with single channel connectors and a multichannel connector, and is used to aggregate data channels for high density applications, such as a back office environment. In the embodiment shown, each twisted pair communication device 100 includes a plurality of twisted pair connectors 104*a-d* that are communicatively connected to a multi-channel connector 106. The twisted pair connectors 104*a-d* can be any of a variety of types of connectors, such as RJ-45 or RJ-21 connectors, configured to receive and transmit data along a communications channel (i.e., a bidirectional stream of uplinked and downlinked data transmitted between endpoints over twisted pair wiring).

The multi-channel connector 106 can be any of a number of types of connectors at which multiple twisted pair data channels can be aggregated and communicated. In one example embodiment, the multi-channel connector 106 is an MRJ21 connector, such as that disclosed in U.S. Pat. No. 6,582,255, assigned to Tyco Electronics Corporation, the entire disclosure of which is hereby incorporated by reference in its entirety.

The multi-channel connector 106 can be interconnected to each of the twisted pair connectors 104*a-d* in a variety of ways; in an example embodiment, as discussed below in connection with FIGS. 5-7, the twisted pair connectors 1-4*a-d* and the multi-channel connector 106 can be connected via mounting to a circuit board, with traces formed therebetween. Additional details regarding twisted pair communication devices are discussed below in connection with FIGS. 5-7.

In the embodiment shown, the system 100 also includes a multi-channel communication cable 110 connectable at the multi-channel connector 106. The multi-channel cable 110 can, in certain embodiments, include a plurality of shielded channels, each including a plurality of twisted pair wire pairs. For example, each channel within the cable 110 could include four or more shielded groupings of four pairs of twisted pair wires. The cable 110 includes a connector 112 at each end complementary to the multi-channel connector 106 of device 102.

Through use of the high density, multi-channel connection between devices (e.g., devices 102*a-b*), fewer cables are required for interconnection of a large number of communication channels, thereby simplifying interconnections among devices. Furthermore, Referring now to FIGS. 5-7, additional details regarding an example of a portion of a high density multichannel twisted pair communication system 100 and associated device 102 are discussed. FIG. 5 illustrates a top plan view of a portion of the system 100 including one device 102. In the example shown, the device 102 includes four RJ-45 connectors configured to receive four RJ-45 plugs 202*a-d* and associated cables 204. The device 102 is further configured to receive a connector 112, shown as an MRJ21 connector, having an associated cable 110 and connected at a multi-channel connector. The device 102 can, as in the example shown, include a body 206 having a front flange 208 extending outwardly to opposing sides with fasteners 210 affixed thereto, such that the device is mountable to a panel, rack, or other telecommunications equipment. In the embodiment shown, the fasteners 210 can be screw-down contact points; however, other fastening devices could be used as well.

Figure 7:
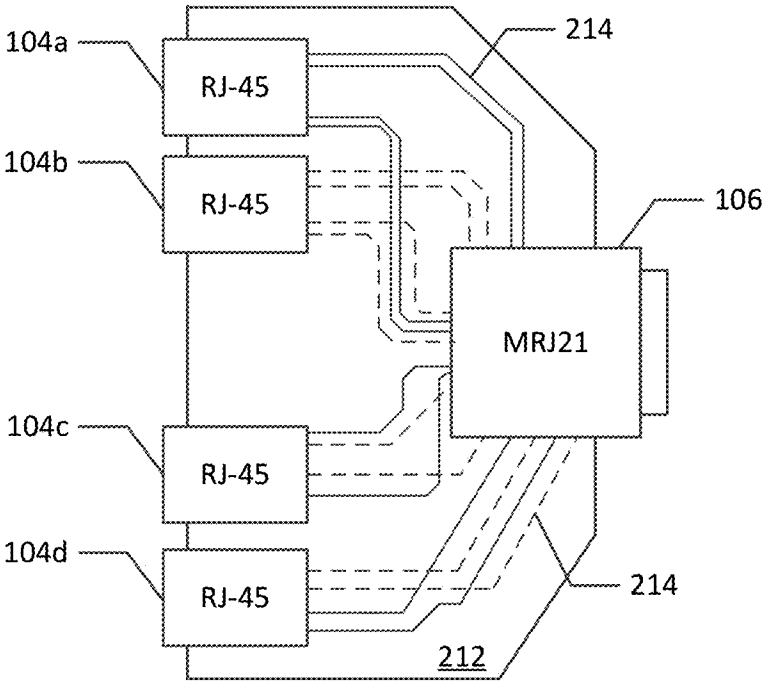
FIG. 7 illustrates a schematic layout view of a circuit board included in a multichannel twisted pair communication device useable in the high density multichannel twisted pair communication system of FIG. 4.
Figure 6:
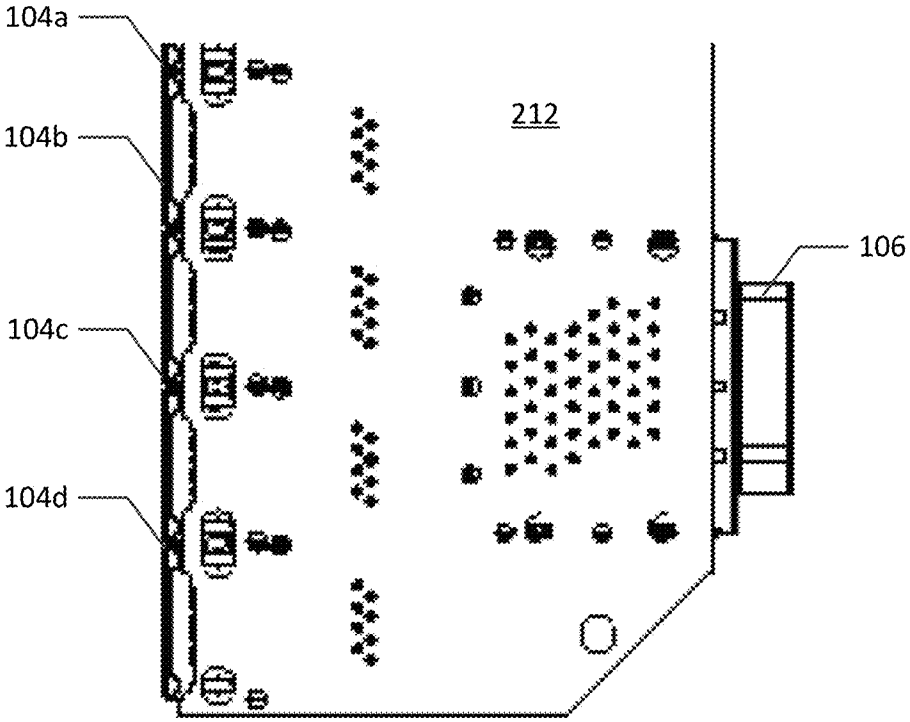
FIG. 6 illustrates a rear side view of a circuit board included in a multichannel twisted pair communication device useable in the high density multichannel twisted pair communication system of FIG. 4.

As seen in FIGS. 6-7, within the device 102, a circuit board 212 can support mounting of the twisted pair connectors 104*a-d* and the multi-channel connector 106. In the embodiment shown in FIG. 6, the twisted pair connectors 104*a-d* are mounted along a first edge of the circuit board 212 and the multi-channel connector 106 is mounted along a second edge opposite the first edge. In alternative embodiments, other configurations or arrangements of connectors could be used. As is also seen in FIG. 6, the twisted pair connectors 104*a-d* and the multi-channel connector 106 are mounted to a front side of the circuit board 212 using through-hole connectors (seen as points extending through the circuit board at the position of each connector).

In some embodiments, the circuit board 212 can also include two or more routing layers, on which conductive traces 214 can be applied to provide a communicative connection between each of the twisted pair connectors 104*a-d* and the multi-channel connector 106. In the embodiment shown, each of the twisted pair connectors 104*a-d* have traces positioned on one or more layers of a circuit board (distinction between the layers shown as solid or dashed lines, respectively). In some embodiments, the tracks 214 are spaced apart (e.g., either laterally or on different layers) to reduce crosstalk among the different channels routed on the board (i.e., from different twisted pair connectors 104*a-d*). Although in the embodiment shown only four tracks are illustrated as extending from each of the twisted pair connectors 104*a-d* to the multi-channel connector 106, this is simply for simplicity of illustration; generally, tracks 214 of a differential pair will be routed near each other by placing traces along the same route but on different layers of a circuit board. Accordingly 8 tracks per channel for 1 gigabit and 10 gigabit Ethernet applications are used. In addition, in some embodiments, one or more capacitive elements can be mounted to the circuit board 212, for example between conductive traces 214, near the multi-channel connector 106. The one or more capacitive elements can be used, for example, to adjust crosstalk among wire pairs in the multi-channel connector 106, and on the circuit board 212.

Figure 1:
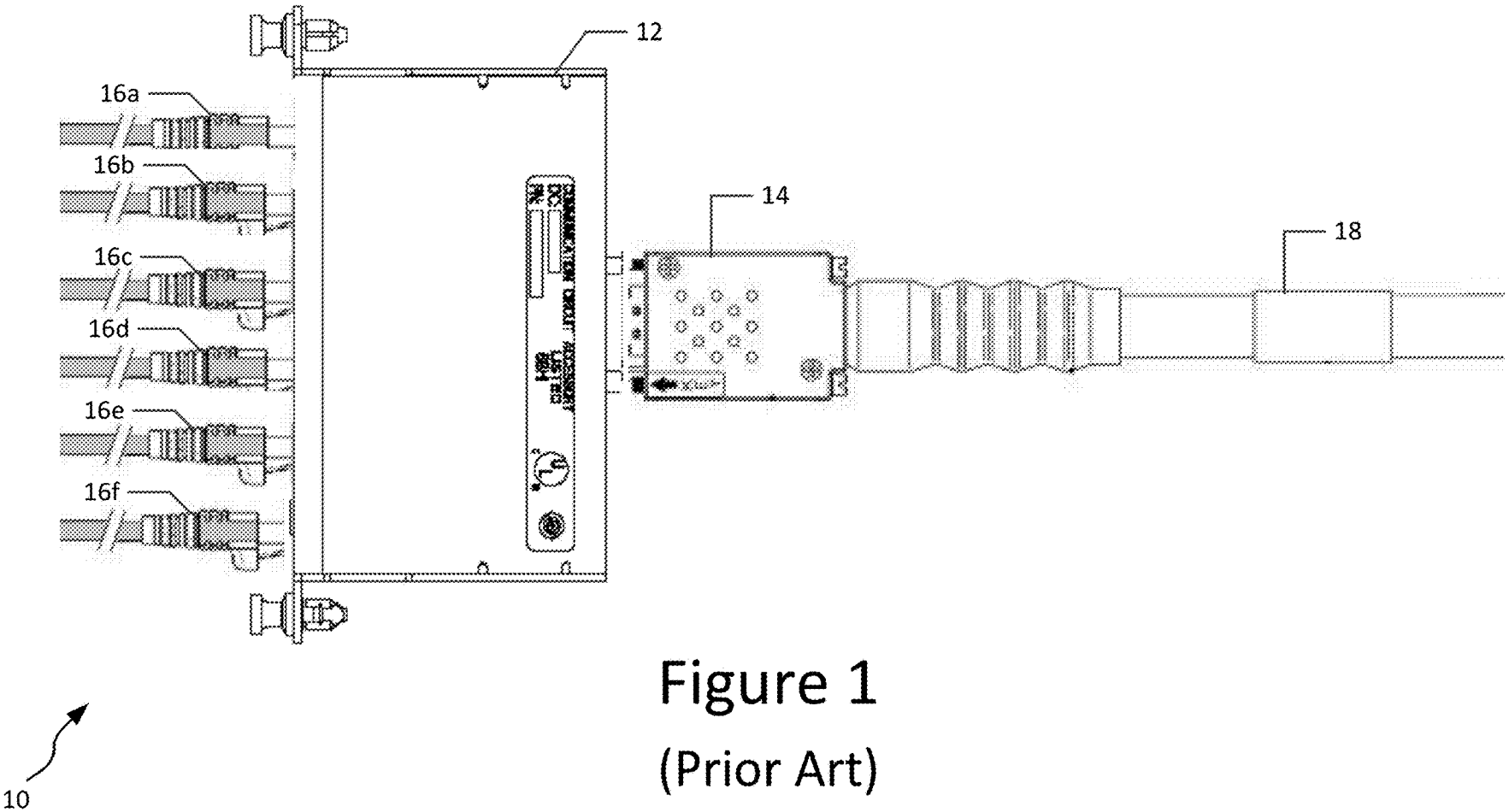
Figure 1 (Prior Art)
FIG. 1 illustrates a portion of a prior art high density multichannel twisted pair communication system.
Figure 3:
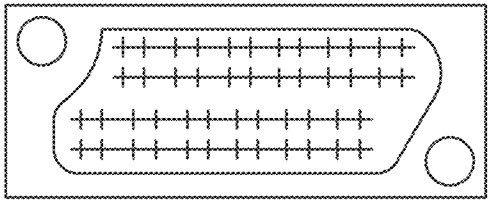
Figure 3 (Prior Art)
FIG. 3 is a schematic view of an example connector used in the high density multichannel twisted pair communication system of FIG. 1.
Figure 2:
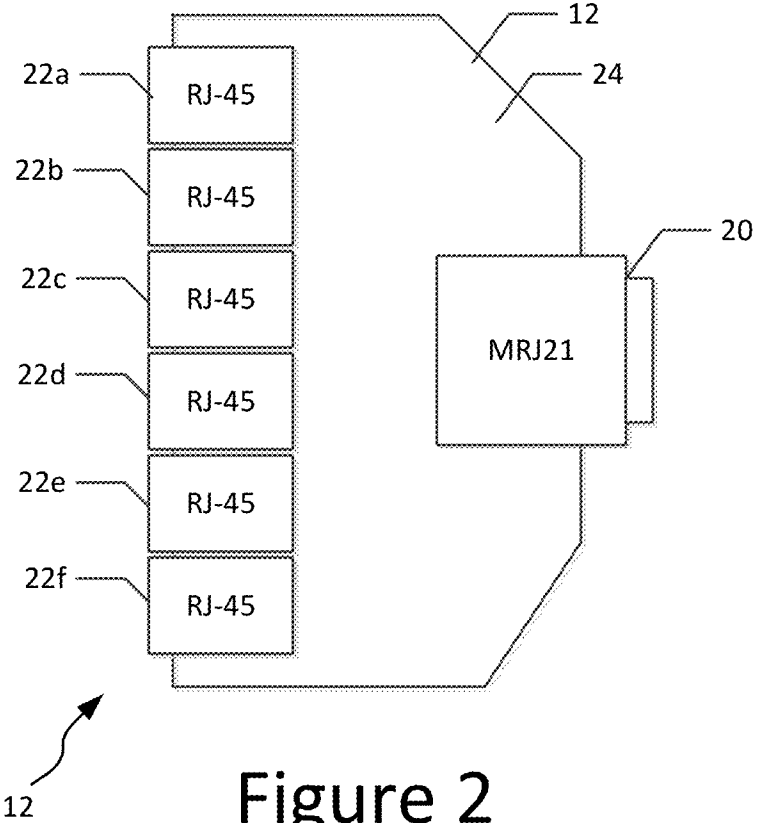
Figure 2 (Prior Art)
FIG. 2 is a schematic view of the high density multichannel twisted pair communication system of FIG. 1.
Figure 5:
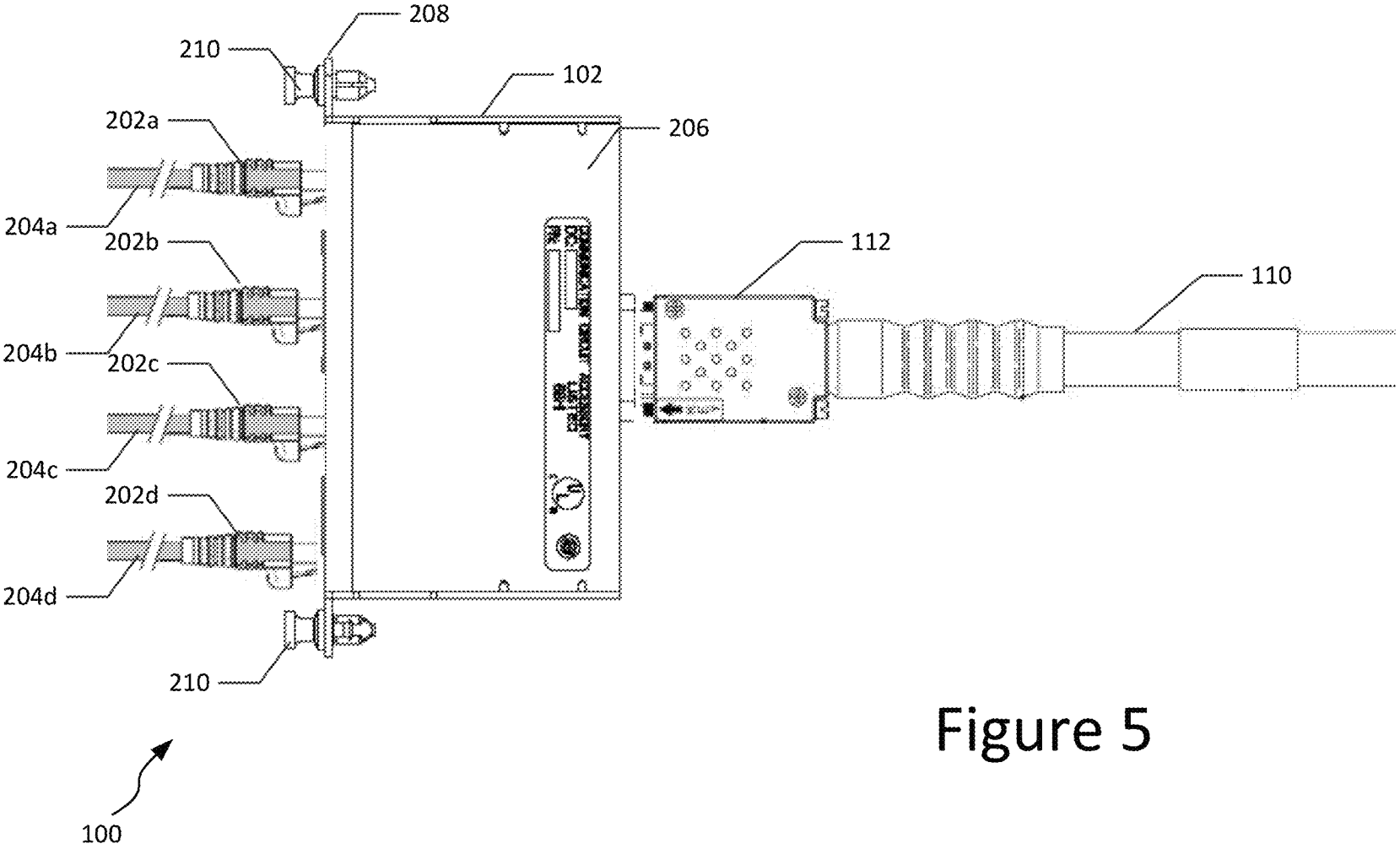
FIG. 5 illustrates a portion of the high density multichannel twisted pair communication system of FIG. 4.

In contrast to the arrangement in FIGS. 1-3 in which all of the wire pairs in the MRJ21 connector are used, as arranged in FIGS. 5-7, it is noted that although an MRJ21 connector includes 24 pairs of wires, only 16 pairs of wires are required for use, because only four twisted pair connectors are used, each of which includes up to eight wires (four pairs). Accordingly, some of the wire pairs within such a multi-channel connector can be unused. As seen in further detail in FIGS. 8-9, unused pairs can be selected to further isolate each channel that is in use within the multichannel connector 106, such that alien crosstalk effects can be further reduced, allowing for higher-frequency operation and improved performance in the range of frequencies supporting 1 gigabit and 10 gigabit Ethernet applications.

Figure 8:
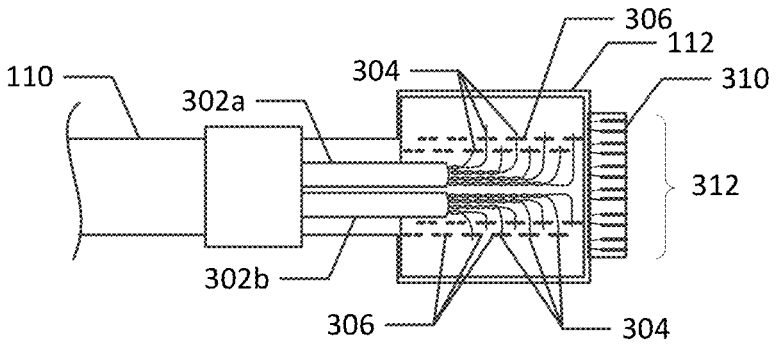
FIG. 8 illustrates an example arrangement of a connector used to interface with a multichannel twisted pair communication device in a high density multichannel twisted pair communication system.
Figure 9:
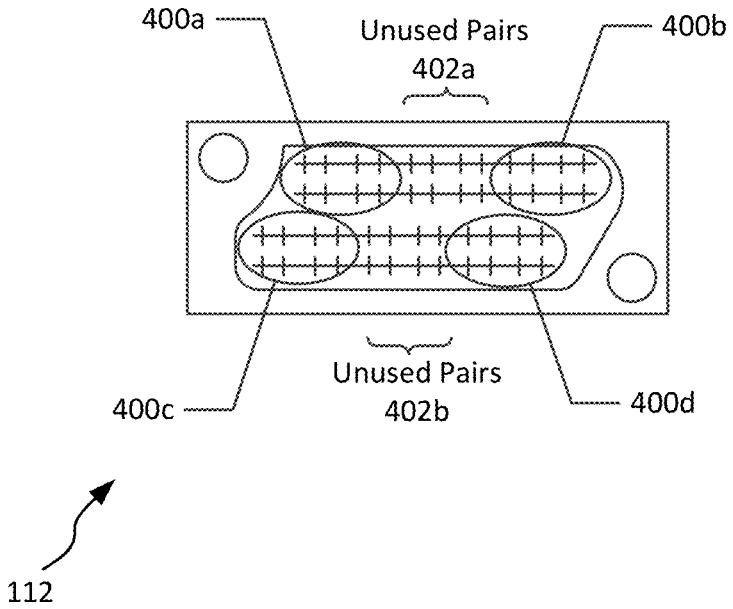
FIG. 9 illustrates an example pin assignment in a high density multichannel twisted pair connector, according to a possible embodiment.

FIGS. 8-9 illustrate details of a multi-channel connector useable as the connector 112 of the cable 110, in connection with connector 106 of device 102. As seen in FIG. 8, a schematic view of a multichannel twisted pair cable 110 and associated connector 112 are shown that use fewer than all available contacts of the connector 112. In the embodiment shown, the cable 110 includes a sheath 300, within which a plurality of channels 302 of twisted pair wires are included. In the embodiment shown, two channels 302*a-b* are shown, while two other channels could reside on a back side of the connector (not shown), thereby resulting in four used twisted pair channels within the connector 112. In some embodiments, each channel 302 is surrounded by a sheath providing shielding against alien crosstalk among the channels. In alternative embodiments, each wire pair is individually shielded, rather than (or in addition to) shielding on a per-channel basis.

Within the connector 112, each twisted pair wire 304 is untwisted and routed to a corresponding insulation displacement contact 306. The insulation displacement contacts 306 are mounted to a circuit board 308 within the connector 112, which routes signals to a card edge connector 310. The card edge connector 310 includes a plurality of card edge contacts 312 sized and oriented to be received within a multi-channel connector, such as connector 106.

It is noted that, even though the card edge connector 310 includes 12 pairs of contacts (positioned along the top and bottom of the card edge connector 310), fewer than all of these contacts are used. As illustrated in the diagram of FIG. 9, only each outer set of four pairs of contacts (denoted as channels 400*a-d*) are used, leaving the inner four pairs of a top and bottom row of contacts unused (shown as unused channels 402*a-b*). By separating the "in use" contacts as far as possible within the connectors 106, 112, alien crosstalk between communication channels can be reduced despite the compact nature of a high density connector, such as an MRJ21 connector. In addition, in some embodiments, the unused contacts can be grounded within the device 102, thereby further reducing a level of alien crosstalk between communication channels.

Figure 10:
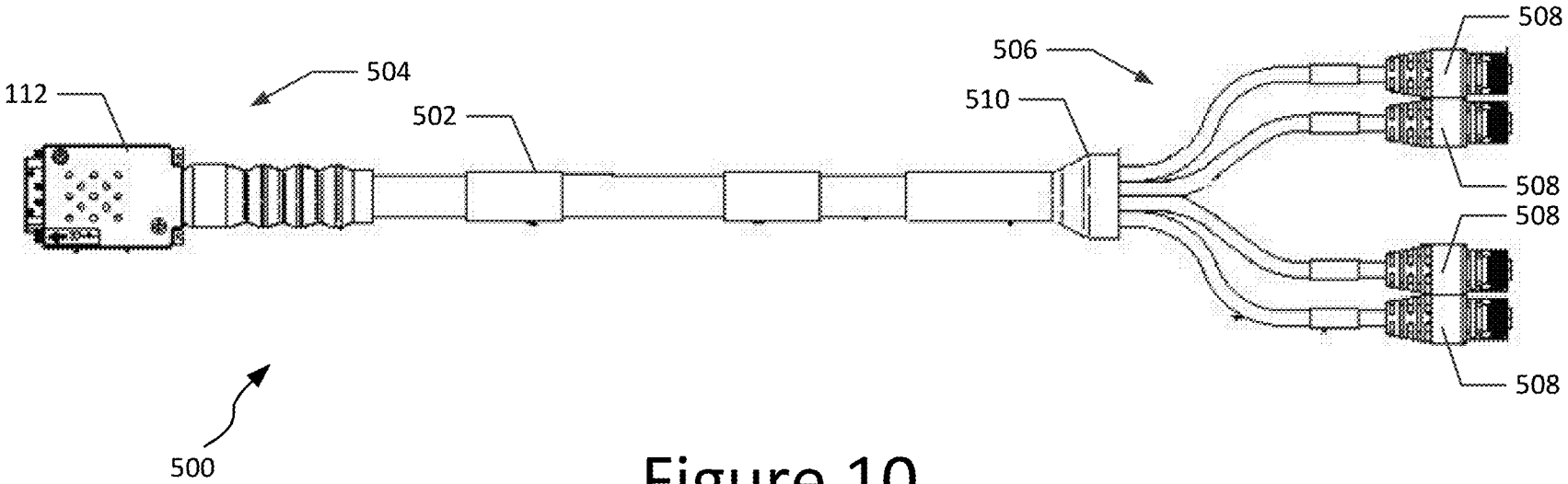
FIG. 10 illustrates an example multi-channel cable useable with a multichannel twisted pair communication device, such as those illustrated in FIGS. 4-7.

FIG. 10 illustrates an example cable 500 including a multi-channel connector, for example for use with one of the twisted pair communication devices 102 described above in connection with FIGS. 4-9. In general, the cable 500 can be used in systems where high-speed data communications are desirable (e.g., 10 gigabit (10 GBASE-T) Ethernet applications), but multi-channel connectors are only present or unpopulated at one of two devices intended to be communicatively interconnected.

The cable 500 includes a cable body 502, having first and second ends 504, 506, respectively. In the embodiment shown, the cable 500 includes a multi-channel connector 112 at a first end, configured to provide a communicative connection to connector 106 of a twisted pair communication device 102. At the second end, the cable 500 includes a plurality of twisted pair connectors 508 each configured to provide a communicative connection to a single communication channel. Although in the embodiment shown the twisted pair connectors 508 are illustrated as RJ-45 connectors, other connector types could be used as well. A fanout 510 positioned along the cable body 502 provides a location at which each of the communication channels can be separated from each other. As discussed above in connection FIGS. 8-9, in various embodiments of cable 500, within the body 502 of the cable each twisted pair could be individually shielded, or shielding could be provided on a per-channel basis (i.e., for each of the four channels present). In still further embodiments, shielding could be provided within the cable body 502 both for each pair and for each channel.

Figure 11:
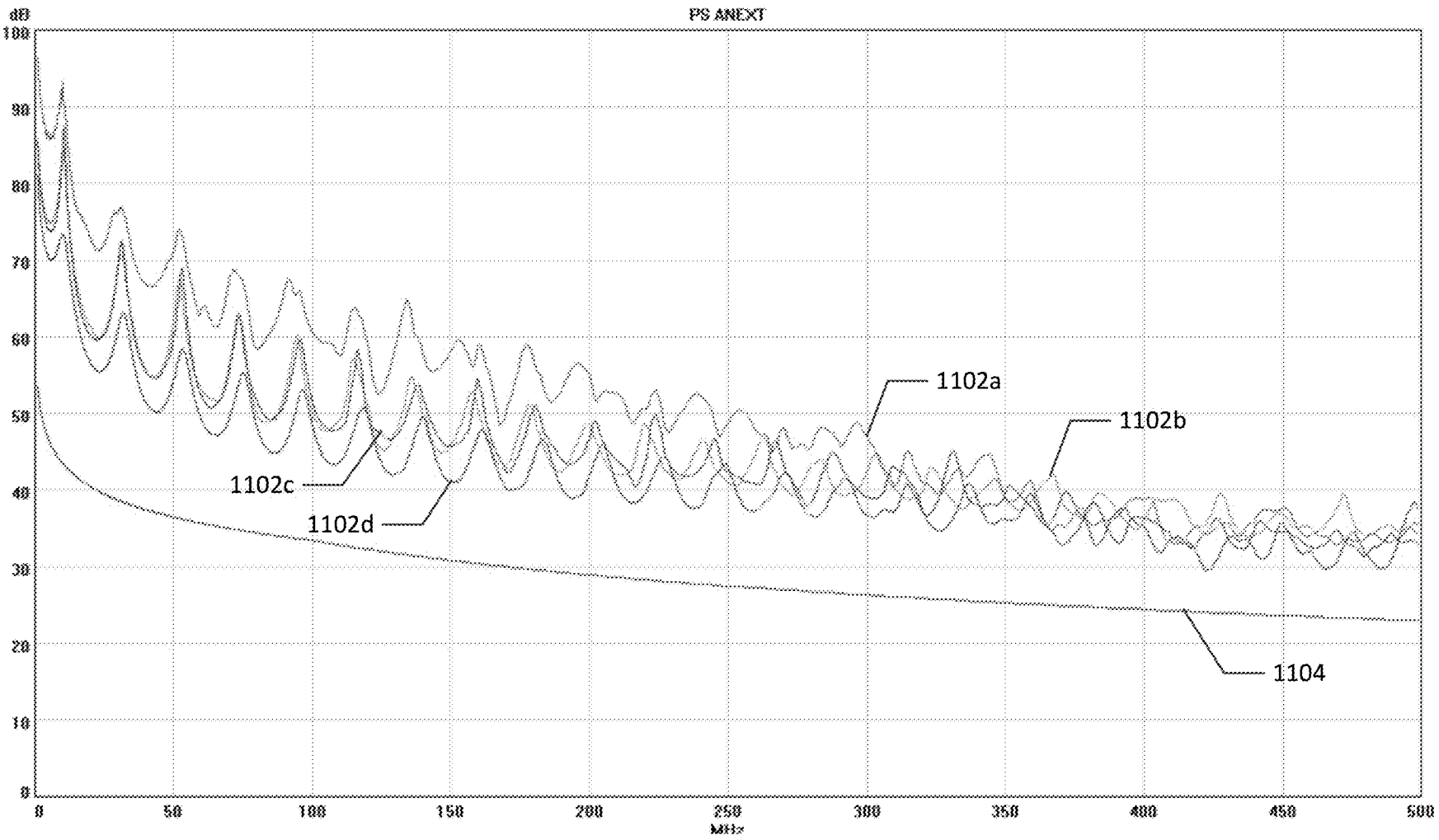
FIG. 11 is a chart illustrating power sum alien crosstalk between channels in a high density multichannel twisted pair connector.
Figure 12:
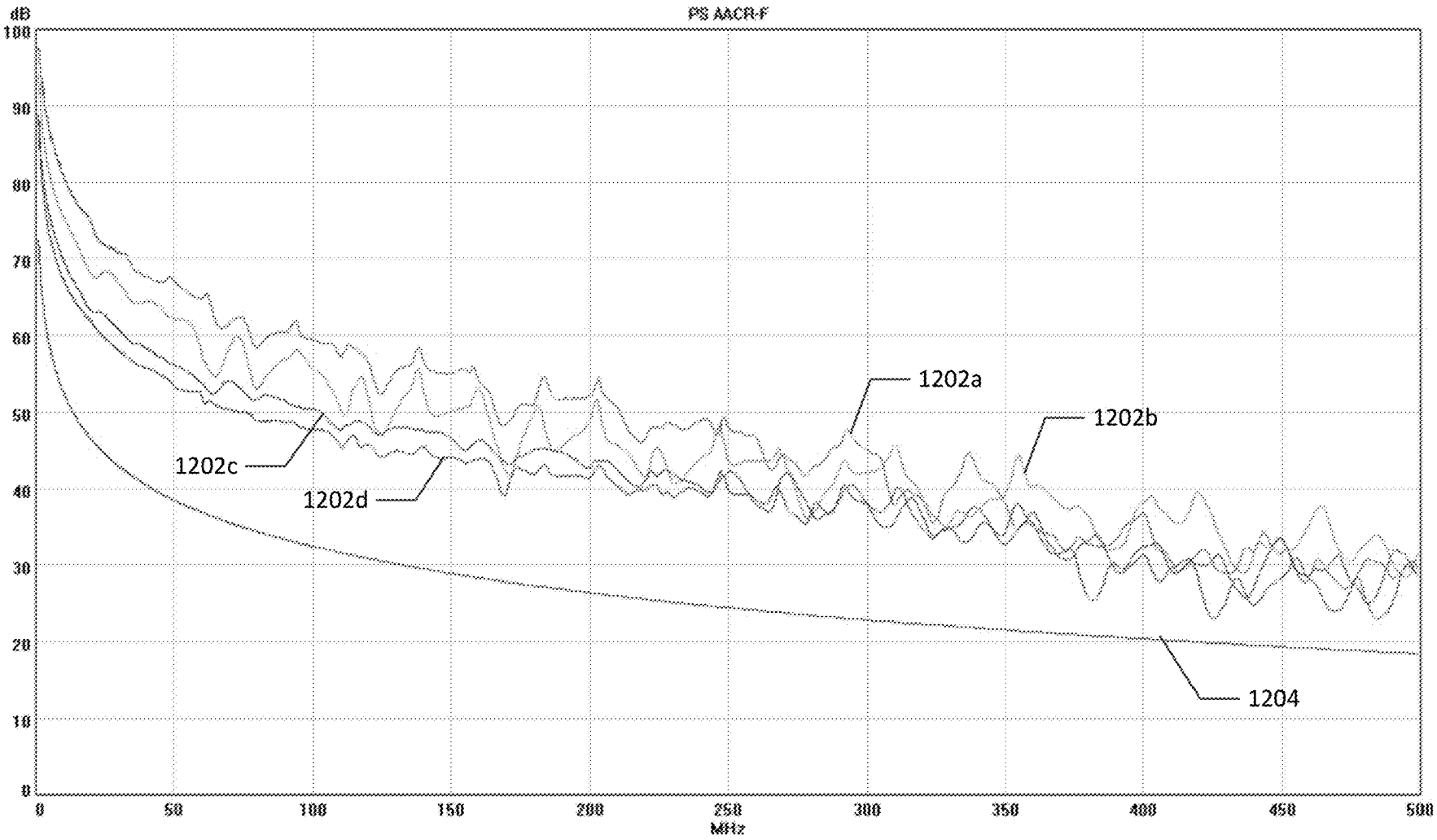
FIG. 12 is a chart illustrating a power sum attenuation to crosstalk ratio at a far end in a high density multichannel twisted pair connector.

Referring now to FIGS. 11-12, charts illustrating crosstalk observed among communication channels at an MRJ21 connector interface are shown at different frequencies, assuming the arrangement shown in FIGS. 8-9 in which used channels are maintained at outer edges of the connector. It is recognized that, for use in 10 gigabit (10 GBASE-T) Ethernet applications, standards set by ANSI standard TIA TSB 155-A must be reached, relative to crosstalk attenuation effects. As seen in chart 1100 of FIG. 11, as frequency increases, a power sum of alien crosstalk observed on each pair is illustrated. It can be seen that the signal measurements on each channel (seen as graphed lines 1102*a-d*) fall within a level deemed acceptable by a threshold 1104 for acceptable power sum alien crosstalk interference up to 500 MHz, and therefore are acceptable for up to 10 gigabit Ethernet applications. Additionally, and as seen in chart 1200 of FIG. 12, the power sum attenuation to crosstalk ratio at the far end at each channel 1202*a-d* remains above the threshold level 1204 required for up to 10 gigabit Ethernet applications.

The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. A twisted pair communications device comprising:

a multi-channel cable including a plurality of twisted pair wires each associated with a different twisted pair communication channel;

a multi-channel connector communicatively connected to each of the plurality of twisted pair wires at a first end of the multi-channel cable and configured to transmit and receive communication signals associated with each of the twisted pair communication channels on the multi-channel twisted pair cable, the multi-channel connector comprising a plurality of contacts disposed in a plurality of rows within the connector;

wherein first and second groups of the plurality of contacts are associated with different communication channels and are communicatively connected to the respective associated twisted pair wires by a plurality of conductors, and wherein a third group of the plurality of contacts are unassociated with and not connected to any of the plurality of twisted pair wires in the multi-channel connector is positioned between and separates the first and second groups of the plurality of contacts associated with different twisted pair communication channels.

2. The twisted pair communications device of claim 1, wherein each of the plurality of twisted pair wires connected to the first and second groups of contacts are further connected to a respective RJ-45 connector.

3. The twisted pair communications device of claim 1, wherein the multi-channel connector is capable of supporting electrical signals in a range of about 100 MHz to about 500 MHz.

4. The twisted pair communications device of claim 1, wherein the device supports 10 gigabit Ethernet communications.

5. The twisted pair communications device of claim 1, further comprising a circuit board to which the the multi-channel connector is mounted, the circuit board including conductive traces communicatively connecting the first and second groups of contacts to each of the respective associated of twisted pair wires.

6. The twisted pair communications device of claim 5, wherein the conductive traces on the circuit board are spaced apart to minimize crosstalk between the conductive traces.

7. The twisted pair communications device of claim 6, further comprising a plurality of capacitive elements mounted across two or more conductive traces.

8. The twisted pair communications device of claim 7, wherein fewer than 24 wire pairs are connected to the multi-channel connector.

9. The twisted pair communications device of claim 1, wherein the multi-channel connector comprises at least 8 wire pairs.

10. The twisted pair communications device of claim 9, wherein four twisted pair connectors are communicatively connected to the multi-channel connector, each of the four twisted pair connectors operable using four wire pairs.

11. The twisted pair communications device of claim 1, wherein the third group of unassociated contacts of the multi-channel connector are connected to ground.

12. The twisted pair communications device of claim 1, wherein alien crosstalk between the plurality of channels is reduced by separation of the by the first and second groups of the plurality of contacts by the third group of the plurality of contacts that are unassociated with and not connected to any of the twisted wire pairs.

13. The twisted pair communications device of claim 1, further comprising a second multi-channel connector communicatively connected to each of the plurality of twisted pair connectors wires at a second end of the multi-channel cable and configured to transmit and receive communication signals associated with each of the twisted pair communication channels on a the multi-channel twisted pair cable.

14. The twisted pair communications device of claim 13, wherein the second multi-channel connector comprises a plurality of contacts disposed in a plurality of rows within the connector;

wherein first and second groups of the plurality of contacts of the second multi-channel connector are associated with different communication channels and are communicatively connected to the respective associated twisted pair wires by a plurality of conductors, and wherein a third group of the plurality of contacts of the second multi-channel connector are unassociated with and not connected to any of the plurality of twisted pair wires in the multi-channel connector is positioned between and separates the first and second groups associated with different twisted pair communication channels.

15. The twisted pair communications device of claim 1, further comprising a plurality of twisted pair connectors at a second end of the multi-channel cable, each of the plurality of twisted pair connectors configured to provide a communicative connection to an associated single one of the twisted pair communication channels.

16. The twisted pair communications device of claim 15, wherein each of the plurality of twisted pair connectors includes an RJ-45 connector.

* * * * *